US005570822A

United States Patent [19]

LeMarbe et al.

[11] Patent Number: 5,570,822

[45] Date of Patent: Nov. 5, 1996

[54] STATIC MIXING NOZZLE

[75] Inventors: Edward S. LeMarbe, Ballwin, Mo.; Sao Van Nguyen, Randolph; Paul Cox, Brighton, both of Mass.

[73] Assignee: Jet Spray Corp., Norwood, Mass.

[21] Appl. No.: 376,421

[22] Filed: Jan. 23, 1995

Related U.S. Application Data

[63] Continuation-in-part of Ser. No. 991,440, Dec. 16, 1992, Pat. No. 5,383,581.

[51] Int. Cl.[6] ..... B65D 83/00

[52] U.S. Cl. ..... 222/459; 222/129.1; 222/145.6; 239/432; 366/340

[58] Field of Search ..... 222/129.1, 129.2, 222/129.3, 129.4, 145.5, 145.6, 459; 239/432; 366/336, 337, 340

[56] References Cited

U.S. PATENT DOCUMENTS

| | | | |
|---|---|---|---|
| 3,923,288 | 12/1975 | King | 366/336 |
| 3,941,355 | 3/1976 | Simpson | 366/336 X |
| 4,370,062 | 1/1983 | Moody | 239/432 X |
| 4,610,145 | 9/1986 | Arzberger | 222/146.1 X |
| 4,856,676 | 8/1989 | Emody | 222/129.1 X |
| 4,907,725 | 3/1990 | Durham | 222/459 X |
| 5,129,581 | 7/1992 | Brawn et al. | 239/432 X |
| 5,203,474 | 4/1993 | Haynes | 222/459 X |
| 5,327,941 | 7/1994 | Bitsakis et al. | 366/340 X |
| 5,383,581 | 1/1995 | LeMarbe et al. | 222/459 |
| 5,443,183 | 8/1995 | Jacobsen et al. | 222/145.6 |

*Primary Examiner*—Joseph Kaufman

*Attorney, Agent, or Firm*—Wolf, Greenfield & Sacks, P.C.

[57] ABSTRACT

A static mixing nozzle used with a dispenser system thoroughly mixes one or more liquids. The static mixing nozzle has an insert having a housing with a plurality of baffles arranged in a staggered and alternating pattern throughout the passage. The baffles cause turbulence which mixes the liquid. Static mixing nozzles with different numbers of baffles may be used in the dispenser system to accommodate the different types of concentrates and syrups which may be used. The insert is removable and may be formed in parts which can be easily separated and cleaned. The insert has a ridge with an outer diameter greater than that of the nozzle, thus allowing the insert to be manually removed.

29 Claims, 4 Drawing Sheets

10
22
20
24
26
28
30
32
34
36
38
50
42
54
64
44
16
14
18
14
12

STATIC MIXING NOZZLE

This application is a continuation-in-part of application Ser. No. 07/991,440, filed on Dec. 16, 1992, now U.S. Pat. No. 5,383,581.

FIELD OF THE INVENTION

This invention relates generally to a nozzle for a dispenser system and more particularly to a static mixing nozzle for a dispenser system which can thoroughly mix highly concentrated viscous material.

BACKGROUND OF THE INVENTION

Post-mix dispenser systems are designed to mix a predetermined ratio of concentrate or syrup with water to produce a desired beverage upon demand. The amount of concentrate or syrup and water dispensed by the system varies, depending upon the type of beverage being produced. Typically, water to concentrate or syrup ratios of five to one or greater involve thick and viscous concentrates or syrups, such as for cola or orange juice. Dispenser systems have had difficulties in sufficiently mixing high ratios of water to concentrate or syrup. Often the resulting beverage has not been thoroughly mixed. Post-mix dispenser systems which must mix these thick and viscous concentrates and syrups have employed a variety of different techniques.

One technique involves adding a mechanical motor to drive one or more rotating blades in a mixing chamber through which the concentrate or syrup and water mixture passes. The rotating blades mix the concentrate or syrup and water to produce the beverage. Unfortunately, this solution requires substantial modifications to the dispenser system to make additional room for the rotating blades and motor.

Another technique of mixing a thick concentrate or syrup with water involves supplying the concentrate or syrup and water to the spout of the dispenser system at higher pressures than typically found in dispenser systems. At higher pressures, the concentrate or syrup and water are more thoroughly mixed within the spout. Unfortunately, to supply the concentrate or syrup and water at higher pressures and to withstand the higher pressures, requires substantial modifications to the dispenser system.

Accordingly, an object of this invention is to provide a nozzle which can thoroughly mix highly concentrated viscous liquids without substantial modifications to the dispenser system.

Another object of this invention is to provide a static mixing nozzle which does not require rotating blades and a motor to mix liquids.

Another object of this invention is to provide a mixing nozzle which operates at normal operating pressures for dispenser systems.

Another object of this invention is to provide a static mixing nozzle which is easy to clean.

Another object of this invention is to provide an inexpensive nozzle for mixing one or more liquids.

Another object of this invention is to provide an inexpensive nozzle insert which is easy to remove from the dispenser system.

SUMMARY OF THE INVENTION

A static mixing nozzle in accordance with this invention has a through passage with a plurality of baffles connected to the passage. The baffles must be arranged in the passage to prevent a direct line of flow through the passage. Preferably, the baffles are connected on alternating sides and in a staggered pattern down the passage. As one or more liquids pass through the passage, the liquids strike the baffles causing turbulence which mixes the liquids. The arrangement and number of baffles in the static mixing nozzle can vary depending upon the amount of turbulence needed. Liquids which are more difficult to mix will need to pass through more baffles.

The static mixing nozzle may be constructed as part of the spout for a dispenser system or may be constructed as a removable insert which fits snugly within the nozzle of the spout. If the removable insert is formed as a one-piece unit, the insert may be disposable. If the removable insert is formed as a two-piece unit, then the halves of the removable insert can be opened and exposed for easy cleaning.

The static mixing nozzle may be constructed with a ridge at the output end of the nozzle. When the static mixing nozzle is constructed as a removable insert, this ridge allows the insert to be easily grasped for removal from the output end of the nozzle.

The static mixing nozzle may be used with pre-mix and post-mix dispenser systems. A dispenser system may have a variety of removable static mixing nozzle inserts with different numbers of baffles to accommodate different liquids which must be mixed. Unlike some prior systems, the static mixing nozzle operates at standard operating pressures for dispenser systems and does not require rotating blades and a motor.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 1:
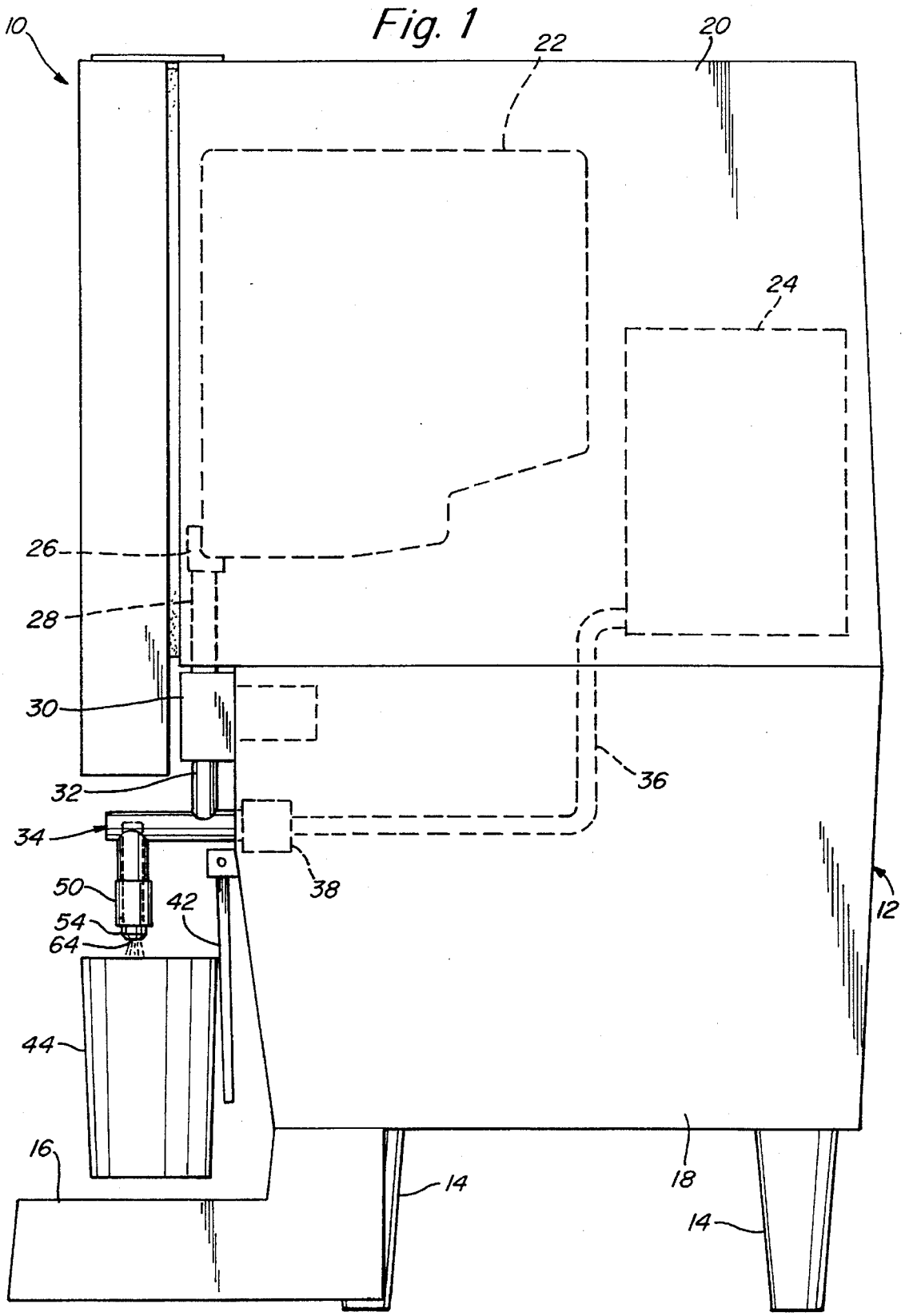
FIG. 1 is a side view of a post mix dispenser with a static mixing nozzle in accordance with the invention.

Referring to the figures, FIG. 1 illustrates a beverage dispenser 10 with a static mixing nozzle in accordance with the invention. The dispenser 10 includes a housing 12 which is supported by four legs 14 attached to the bottom of the housing 12 adjacent the four corners. The bottom of the housing 12 also carries a drip tray 16 along one edge.

The housing 12 includes a lower and upper portion 18 and 20, respectively. The lower portion 18 contains a substantial part of the dispenser refrigeration system including the compressor and the condenser, as well as the dispenser controls and part of the potable water system. The upper portion 20 contains a concentrate container 22, such as the bag-in-box container, and an ice water bath 24. The concentrate container 22 stores concentrate or syrup, such as orange juice concentrate or cola syrup. The ice water bath 24 stores potable water for mixing with the concentrate or syrup.

A concentrate control valve (CCV) 26 and a concentrate line 28 connect the input of a concentrate pump 30 or other type of dispensing mechanism to the concentrate container 22. The output of the concentrate pump 30 is connected to a concentrate intake 32 for a spout 34. When the pump 30 is activated, the pump 30 draws concentrate or syrup from the container 22 and feeds the extracted concentrate to the concentrate intake 32 in the spout 34. The CCV 26, concentrate line 28, and the pump 30 are generally of the type described in U.S. Pat. No. 4,856,676.

Similarly, a water line 36 connects the input of a demand solenoid 38 to the ice water bath 24. The output of the demand solenoid 38 is connected to a potable water intake 40 in the spout 34. When the solenoid 38 is activated, the solenoid 38 permits potable water to be supplied to the water intake 40. The water line 36 and solenoid 38 are generally of the type described in U.S. Pat. No. 4,610,145.

A push handle 42 is connected to the housing 12 below the spout 34. The push handles 42 operates a switch which is part of a control circuit for the pump 30 and the solenoid 38. When the push handle 42 is pressed against the housing 12, the switch is closed completing the control circuit and activating the pump 30 and solenoid 38. When the push handle 42 is released, the switch opens and the pump 30 and solenoid 38 are deactivated. Typically, a cup 44 is used to press the push handle against the housing.

Although a push handle 42 is shown, other actuators may be used to operate the switch in the control circuit, such as a push button. The push button could be designed to close the switch and activate the pump 30 and solenoid 38 for a predetermined period of time when pressed and released. Alternatively, the push button could be designed to only close the switch and activate the pump 30 and solenoid 38 while the push button is being pressed.

Figure 2:
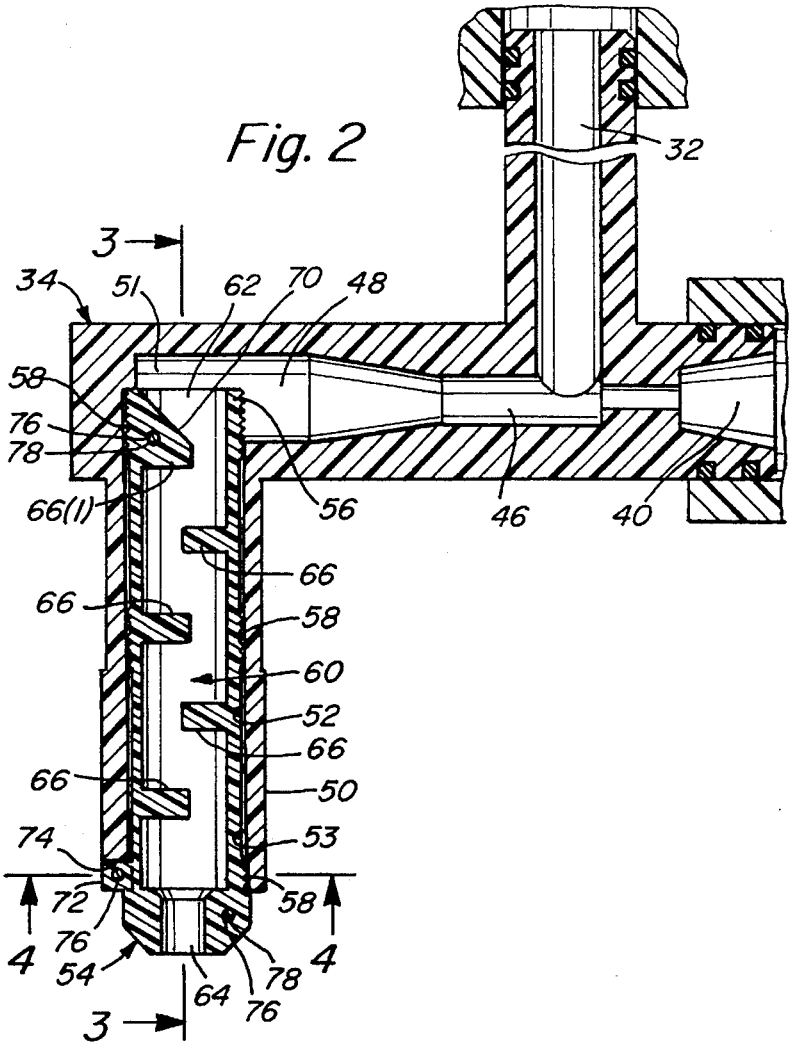
FIG. 2 is a cross-sectional side view of the spout with the nozzle and nozzle insert of FIG. 1.

In FIG. 2, a cross sectional view of the spout 34 is illustrated. The concentrate intake 32 and the water intake 40 are connected to a mixing block 46 at one end of the spout 34. The water intake 40 narrows just before the mixing block 46 to increase the velocity at which water passes through to the block 46. Typically, concentrate or syrup is supplied to the mixing block 46 at about 1–2 PSI and potable water is supplied to the mixing block 46 at about 20 PSI. The mixing block 46 is connected to a horizontal passage 48 which leads to the other end of a spout 34.

A nozzle 50 is connected to the other end of the spout 34 and extends down towards the drip tray 16. The nozzle 50 includes a nozzle passage 52 which extends through the nozzle 50 with one end 51 open to the horizontal passage 48, as illustrated more clearly in FIG. 5. The other end 53 of the passage 48 is open towards the cup 44 and the drip tray 16.

Figure 3:
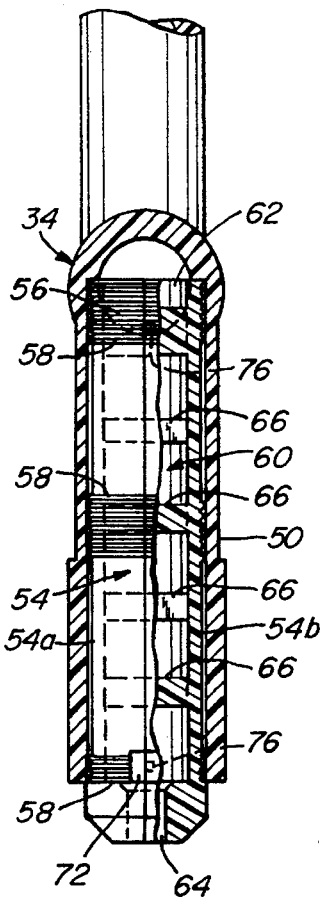
FIG. 3 is a partial cross-sectional end view of the spout with the nozzle and nozzle insert taken along line 3—3 in FIG. 2.
Figure 5:
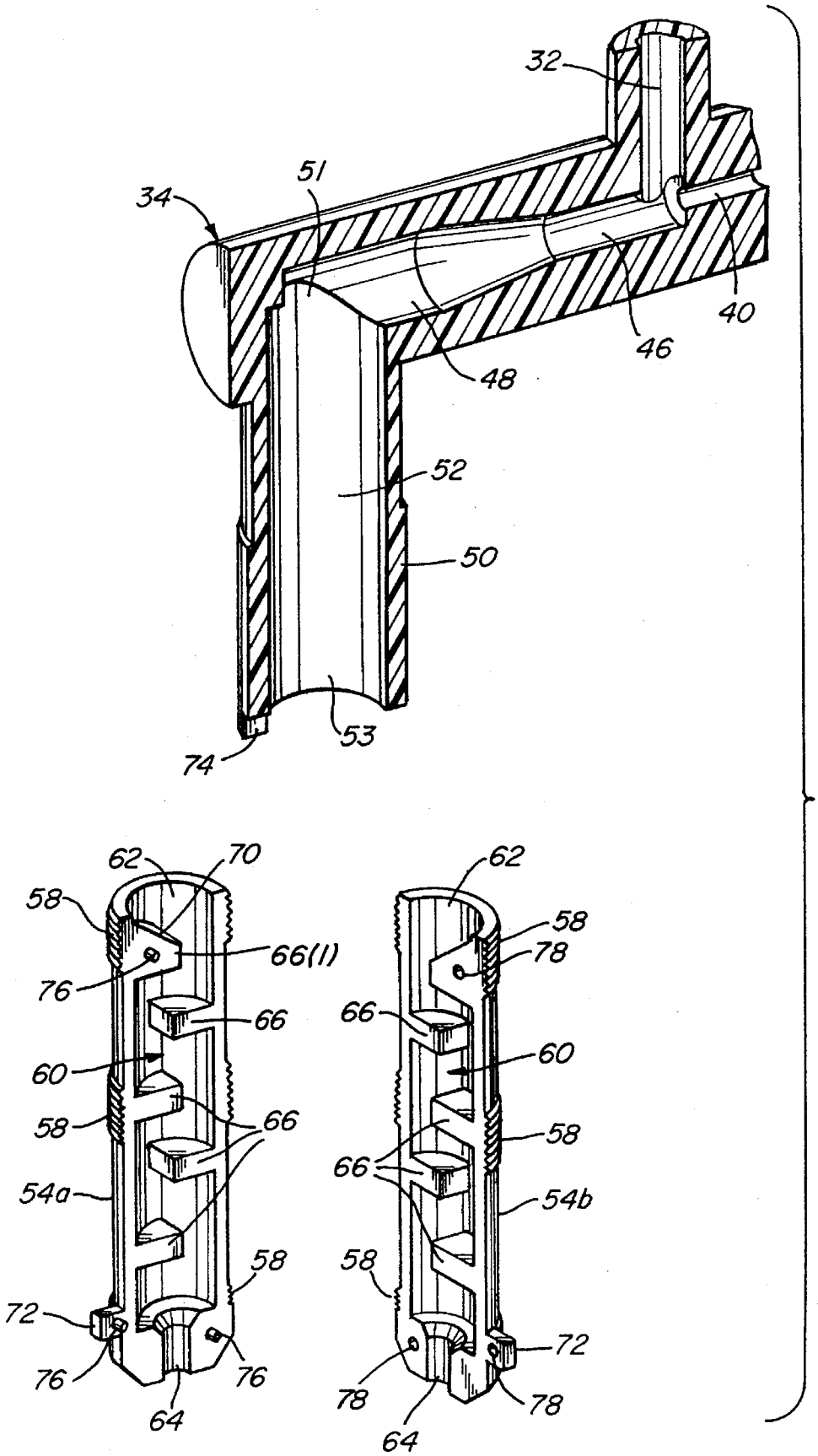
FIG. 5 is an exploded perspective view of the spout with the nozzle and the halves of the nozzle insert.

A nozzle insert 54 is slidably engaged in the nozzle passage 52, with one end 56 of the insert 54 extending partially into the horizontal passage 48. The insert 54 is retained in the passage 48 by sets of ridges 58 which protrude slightly from the outer surface of the insert 54, as illustrated in FIGS. 2, 3 and 5. The ridges 58 engage against the nozzle passage 52 to retain the insert 54 in place. A force of about 50 PSI is necessary to push each set of ridges 58 into the nozzle passage 52. Typically, three sets of ridges 58 are used, although the number of sets of ridges 58 can vary depending upon the amount of force needed to retain the insert 54 in the nozzle passage 52. The insert 54 may also be retained in the nozzle passage 52 by other devices, such as a clamp.

An insert passage 60 extends through the insert 54, with one end 62 of the passage 60 open to the horizontal passage 48 and the other end 64 of the passage 60 open towards the cup 44 and drip tray 16. Typically, the concentrate or syrup and water mixture enters the insert passage 60 at about 22 PSI. This pressure is not sufficient to dislodge the insert 54 from the nozzle passage 52 which required 50 PSI of force to be inserted. Typically, the insert passage 60 will be substantially cylindrical, although the passage 60 can have other shapes. Typically, the opening at the other end 64 is smaller than at the one end 62, to increase the velocity and direct the flow of the mixture as it is dispensed to the cup 44.

Figure 4:
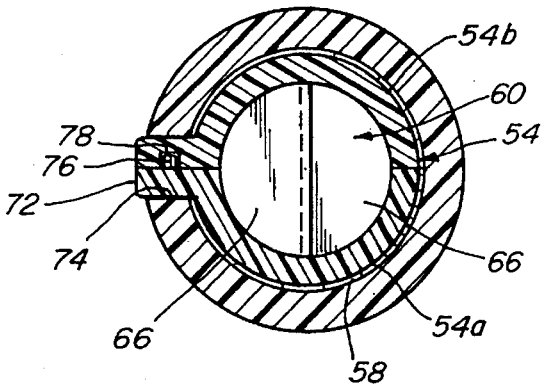
FIG. 4 is a cross-sectional bottom view of the spout with the nozzle and nozzle insert taken along line 4—4 in FIG. 2.

Baffles 66 are connected to the sides of the passage 60. The baffles 66 may be disposed at any distance apart and in any configuration desired, as long as a direct line of flow through the passage 60 is prevented. The particular arrangement for the baffles 66 in the passage 60 will effect the amount of turbulence generated in the passage 60. Preferably, the baffles 66 are connected to alternating sides of the passage 60 in a staggered pattern, with each baffle 66 extending out in a substantially perpendicular direction to surface of the passage 60. This arrangement results in a straight stream of beverage emitted from the other end 64 of the passage 60 to the cup 44. In the preferred arrangement, each baffle 66 is connected to overlap slightly with the baffle 66 just below, as shown more clearly from the bottom view of the spout 34 in FIG. 4.

The number of baffles 66 in the insert passage 60 can vary. Thicker concentrates or syrups will require more baffles 66 in the passage 60 to create sufficient turbulence in the passage 60 to thoroughly mix the concentrates or syrups with water. Typically, a dispenser system 10 will be equipped with a number of different inserts 54, each with a different number of baffles 66, to accommodate the different concentrates and syrups which may be used. Alternatively, a dispenser system 10 may be constructed with a nozzle 50 with a sufficient number of baffles 60 for the thickest concentrate or syrup which may be used. Typically, the insert passage 60 will be constructed with five baffles 66. Five baffles 66 in an insert passage 60 are sufficient to thoroughly mix most orange juice concentrates with water and most cola syrups with water.

The top baffle 66(1), adjacent the one end 62 of the insert passage 60 and the other end of the spout 34, is sloped down into the insert passage 60. The sloped face 70 on the top baffle 66(1) faces towards the horizontal passage 48 and the mixing block 46. Sloping the top baffle 66(1) helps to guide the concentrate or syrup and water mixture in the horizontal passage 48 into the insert passage 60, preventing mixture and pressure from building up in the horizontal passage 48. Excessive pressure in the horizontal passage 48 can restrict the flow of concentrate from a low output pump or dispensing mechanism.

A tab 72 on the outer surface of insert 54 is used to orient the insert 54, particularly the top baffle 66(1), within the nozzle passage 52. As described above, the sloped face 70 of the top baffle 66(1) should face the horizontal passage 48 to prevent the buildup of mixture and pressure in the horizontal passage 48. A groove 74 on the nozzle 50 near the other end 53 of the nozzle passage 52 is designed to accommodate the tab 72. Disposing the tab 72 in the groove 74 properly orients the insert 54 and the top baffle 66(1). In this embodiment, the tab 72 and the groove 74 each have a substantially square shape, although any geometric shape may be used as long as the tab 72 fits within the matching groove 74. Other devices may also be used to orient the insert 54 in the nozzle passage 60, such as a mark on both the insert 54 and the nozzle 50.

FIG. 5 is an exploded perspective view of the spout 34 and the nozzle insert 54 split along the long axis of the insert 54 into halves 54*a* and 54*b*. Each half 54*a* and 54*b* has part of the five baffles 66 and part of the insert passage 60. The halves 54*a* and 54*b* are oriented and connected together with a set of pins 76 on one half 54*a* and a set of holes 78 on the other half 54*b*. The holes 78 in one half 54*b* are designed to accommodate the pins 76 on the other half 54*a*. The engagement of the pins 76 with the holes 78 holds the halves 54*a* and 54*b* together. Typically, three pins 76 and holes 78 are sufficient to orient and connect the halves 54*a* and 54*b*, although any number of pins 76 and holes 78 could be used. Other devices may also be used to orient the two halves 54*a* and 54*b* together, such as a mark on each half.

Cleaning the insert passage 60 and baffles 66 in the insert 54 shown in FIG. 5 is easy. The insert 54 is simply removed from the nozzle passage 52 and is separated into halves 54*a* and 54*b* by disengaging pins 76 from holes 78. The separation provides access to the insert passage 60 and baffles 66.

Although the insert 54 has been illustrated as a removable two-piece unit with halves 54*a* and 54*b*, the insert 54 may also be made as a removable one-piece unit. Since cleaning with the one-piece unit may be more difficult, the one-piece unit could simply be made disposable after a predetermined amount of use. The insert 54 could also be made as a permanent part of the nozzle 50 for the spout 34.

As shown in FIG. 5, the shape of the nozzle passage 52 is designed to accommodate the shape of the nozzle insert 54. In this embodiment, the passage 52 and the insert 54 are both substantially cylindrical, although the passage 52 and insert 54 could have any shape, such as square or triangular. The spout 34 and the insert 54 may be made from any suitably rigid material, such as plastic.

With the static mixing nozzle and dispenser described above, a thick concentrate or syrup can easily be mixed with water to produce a beverage. To obtain a beverage from the dispenser 10 filled with a thick concentrate or syrup, the cup 44 must press the push handle 42 against the housing 20 to close the switch in the control circuit. With the switch closed, the control circuit can activate the pump 30 and the solenoid 38. The activated pump 30 extracts the concentrate or syrup from the container 22 and feeds the concentrate to the concentrate intake 32 of the spout 34. The activated solenoid 38 allows potable water in the ice water bath 24 to enter the water intake 40 of the spout.

The concentrate and water meet in a mixing block 46 in the spout 34, where the first mixing occurs. Typically, the mixing block 46 can not thoroughly mix a thick concentrate or syrup with water. The concentrate or syrup and water mixture in the mixing block 46 proceeds down the horizontal passage 48 towards the other end of the spout. In the passage 48, further mixing occurs when the mixture strikes the end 56 of insert 54 which extends into the passage 48. The engagement between the mixture and the end 56 generates turbulence.

Eventually, the mixture passes over the end 56, strikes the end wall of the passage 48 and is guided down by sloped face 70 of the first baffle 66(1) into the insert passage 60. The sloped face 70 helps to prevent a backup of the mixture in the horizontal passage 48. The backup of mixture could generate excessive pressures in the passage 48 which could cause damage, leaks or poor mixing.

Once in the passage 60, the mixture is subject to a substantial amount of mixing and churning which thoroughly mixes the mixture into the beverage. The baffles 66 are arranged in the passage 60 to prevent the mixture from flowing directly through. As the mixture goes down the passage 60, the mixture strikes each baffle 66. The repeated engagement of the mixture and the baffles 66 generates turbulence which mixes the mixture. Once the mixture has passed the bottom baffle 66, a thoroughly mixed beverage has been produced. After passing the bottom baffle 66, the mixture proceeds out the other end 64 of the passage 60 into the cup 44. Typically, the other end 64 of the passage 60 is smaller than the one end 62 to increase the velocity and guide the beverage as it is discharged into the cup 44.

Figure 6:
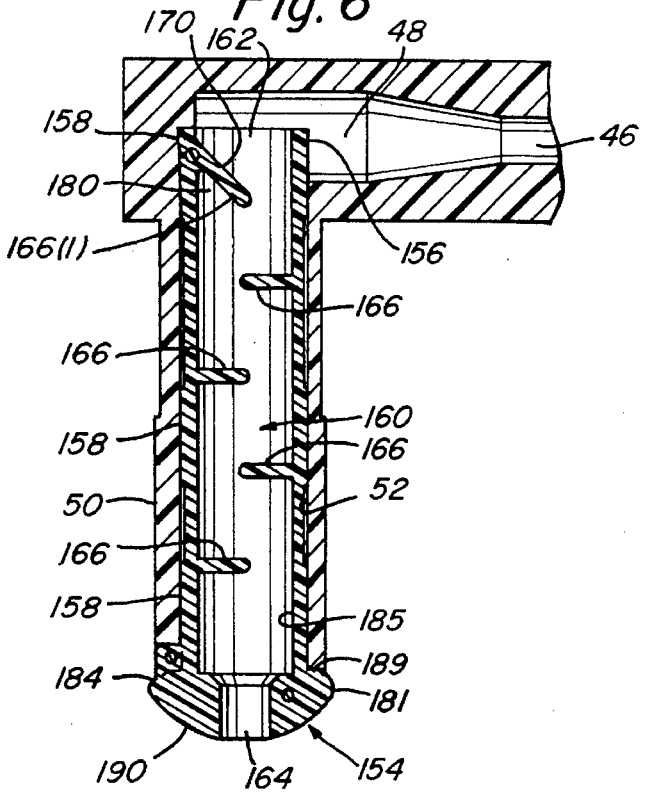
FIG. 6 is a cross-sectional side view of the spout with a static mixing nozzle in accordance with another embodiment of he invention.
Figure 7:
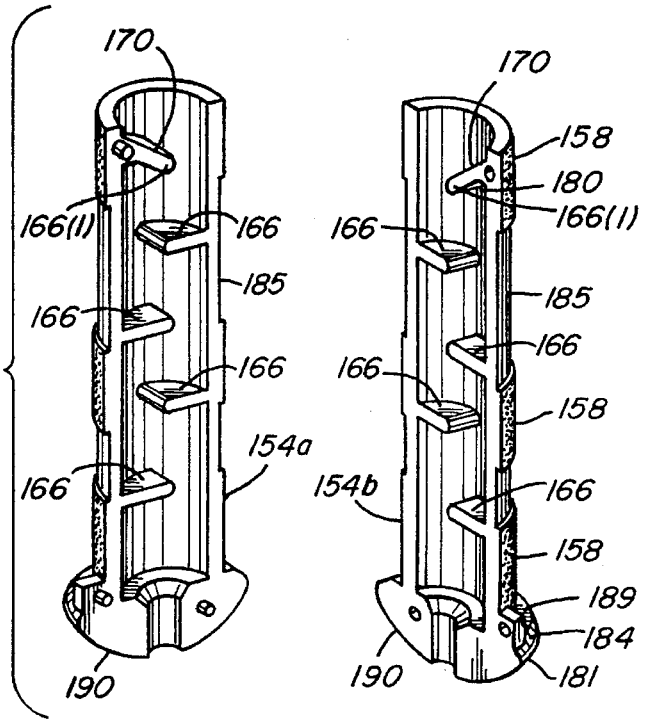
FIG. 7 is a perspective view of the halves of the nozzle inaccordance with the embodiment of FIG. 6.

Another embodiment of a nozzle insert is illustrated in FIGS. 6 and 7. Nozzle insert 154 is slidably engaged in nozzle passage 52 with one end 156 extending into horizontal passage 48. The insert is retained in the passage with ribs 158 which protrude slightly from the outer surface of the insert. These ribs, which have a "sand blast" texture, abut the nozzle passage to retain the insert in place. A force of about 50 psi is necessary to push each rib 158 into the nozzle passage 52. Typically three ribs are used, although the number of ribs can vary depending upon the amount of force needed to retain the insert in the nozzle passage. The insert may also be retained in the nozzle passage by other devices, such as a clamp.

The insert has a sidewall 185 that defines a substantially cylindrical insert passages 160 that extends from one end 162, where the insert passage is open to horizontal passage 48, to an open end 164. The opening at end 164 is smaller than at end 162 to increase the velocity and to direct the flow of the mixture as it is dispensed to the cup 44 (FIG. 1).

Baffles 166 are integrally formed in the insert sidewalls of passage 160. The baffles may be disposed at any distance apart and in any configuration desired, as long as a direct line of flow through the passage 160 is prevented. The number and arrangement of the baffles in the passage affects the amount of turbulence generated. The baffles have an equal thickness that is approximately 60% of the thickness of the insert.

A top baffle 166(1) adjacent end 162 slopes downward into the insert passage so that a sloped face 170 on the top baffle faces horizontal passage 48 and mixing block 46. The slope of the top baffle defines a substantially triangular hollow area 180 between the top baffle and the sidewall of the insert.

At end 164, an outer diameter of the insert is greater than the diameter of nozzle 50 to create a ridge 181. This ridge allows the insert to be easily grasped without tools so that the insert is manually removable from the nozzle passage. The diameter of ridge 181 is substantially the same as the diameter of nozzle 50 where ridge 181 contacts the nozzle, thus forming a shoulder 189 that contacts the nozzle and serves as a stop (along with a shoulder at the inlet end). The diameter of ridge 181 increases with the distance from the nozzle to create an outwardly sloping surface 184 that prevents moisture from collecting between the ridge and the nozzle. At open end 164, the insert has a downwardly directed domed shape 190.

As indicated in FIG. 7, insert 154 may be formed as a two-piece unit with halves 154*a* and 154*b*, or it can be formed as a removable one-piece unit.

Although the static mixing nozzle has been described with respect to post-mix dispenser, the nozzle may be used with pre-mix dispensers and any other application requiring one or more liquids to be mixed. In a pre-mix dispenser, the nozzle could remix a single liquid to eliminate any settling which may have occurred during storage.

Having now described two preferred embodiments of the present invention, it is now apparent to those skilled in the art that numerous other embodiments and modifications thereof are contemplated as falling within the scope of the present invention as defined by the appended claims.

What is claimed:

1. A beverage dispenser system comprising:

a potable water source for supplying potable water;

a concentrate container for storing a liquid; and a beverage discharge assembly including:

a mixing block having a passage with a receiving end for receiving the liquid from the concentrate container and for receiving potable water from the potable water source, and an outlet end;

a nozzle having a nozzle passage having a first end fluidly coupled to the outlet end of the mixing block passage and a second end at a liquid-dispensing location; and a removable insert extending into the nozzle passage and having a housing defining an insert passage and a plurality of inwardly-directed baffles, the insert having an inlet end for receiving the liquid and the potable water from the mixing block and an outlet end for providing a mixed liquid, the housing having at the outlet end an outer diameter greater than an outer diameter of the nozzle adjacent the outlet end of the insert so as to define an insert ridge extending beyond the nozzle to provide a gripping surface.

2. The beverage dispenser system as set forth in claim 1, wherein the insert housing has a first inner diameter at the inlet end and a second inner diameter at the outlet end, the second inner diameter being less than the first inner diameter.

3. The beverage dispenser system as set forth in claim 2, wherein, where the ridge has an outer surface that slopes away from the nozzle.

4. The beverage dispenser system as set forth in claim 3, wherein the plurality of inwardly directed baffles includes a top baffle having a sloped face, the top baffle deflecting liquid from flowing directly from the first end to the second end of the nozzle passage, the top baffle and a side wall of the housing defining a hollow, substantially triangular cross-sectional region.

5. The beverage dispenser system as set forth in claim 4, wherein said nozzle passage has an alignment groove, and said insert housing has an alignment tab that mates with said alignment groove so that the nozzle passage and the insert housing are aligned.

6. The beverage dispenser system according to claim 1, wherein the insert includes a plurality of ribs on an outer surface of the insert housing to permit the nozzle passage firmly maintain the insert and to enable slidable removal of the insert from the nozzle passage through the output end of the nozzle passage when a force is applied to the insert.

7. The beverage dispenser system according to claim 1, wherein the ridge is sufficiently large so that the insert can be manually removed.

8. The beverage dispenser system as set forth in claim 1, wherein the ridge has an outer surface that slopes away from the nozzle.

9. The beverage dispenser system as set forth in claim 1, wherein the plurality of inwardly directed baffles includes a top baffle having a sloped face, the top baffle deflecting liquid from flowing directly from the first end to the second end of the nozzle passage, the top baffle and a side wall of the housing defining a hollow, substantially triangular cross-sectional region.

10. The discharge assembly according to claim 1, wherein the insert housing has sidewalls along the insert passage between the first and second ends of the nozzle passage, wherein the baffles are perpendicular to the sidewalls and have a uniform thickness.

11. The discharge assembly according to claim 1, wherein the second end of the nozzle has an inner diameter that is sufficient to permit the insertion and removal of the insert through the second end of the nozzle.

12. A discharge assembly for mixing at least one stored liquid comprising:

a nozzle having sidewalls defining a nozzle passage and having an inlet end for receiving a liquid, and an outlet end; and a removable insert extending into the nozzle and having a housing defining an insert passage and a plurality of inwardly-directed baffles, the insert housing further having a nozzle end near the outlet end of the nozzle passage, the housing having at the nozzle end an outer diameter greater than an outer diameter of the nozzle adjacent the nozzle end of the insert so as to define an insert ridge extending beyond the nozzle to provide a gripping surface.

13. The discharge assembly as set forth in claim 12, wherein said insert housing has a first inner diameter and a second inner diameter at the nozzle end, the second inner diameter being less than the first inner diameter.

14. The discharge assembly as set forth in claim 12, wherein the ridge has an outer surface that slopes away from the nozzle.

15. The discharge assembly as set forth in claim 12, wherein the plurality of inwardly directed baffles includes a top baffle having a sloped face, the top baffle deflecting the liquid from flowing directly from the first end to the second end of the nozzle passage, the top baffle and a sidewall of the housing defining a hollow, substantially triangular cross-sectional region.

16. The discharge assembly according to claim 12, wherein the insert includes a plurality of ribs on an outer surface of the insert housing to permit the nozzle passage firmly maintain the insert and to enable slidable removal of the insert from the nozzle passage through the outlet end of the nozzle passage when a force is applied to the insert.

17. The discharge assembly according to claim 12, wherein the insert housing has sidewalls along the insert passage between the first and second ends of the nozzle passage, wherein the baffles are perpendicular to the sidewalls and have a uniform thickness.

18. The discharge assembly according to claim 12, wherein the second end of the nozzle has an inner diameter that is sufficient to permit the insertion and removal of the insert through the second end of the nozzle.

19. A discharge assembly for mixing at least one stored liquid comprising:

a nozzle having a vertical passage and a horizontal passage integrally formed within a nozzle housing, the horizontal passage having an inlet end for receiving liquid and an outlet end, the vertical passage having a first end fluidly coupled to the outlet end of the horizontal passage and a second end at a liquid dispensing location; and a removable insert having a housing defining an insert passage and having a plurality of inwardly-directed baffles, the insert housing further having a nozzle end near the outlet end of the vertical passage, wherein the insert housing has sidewalls along the insert passage between the first and second ends of the vertical passage, wherein the baffles are perpendicular to the sidewalls and have a uniform thickness, wherein the nozzle end of the insert has a ridge that has a maximum outside diameter greater than an outside diameter of the nozzle housing to provide a gripping surface.

20. The discharge assembly as set forth in claim 19, wherein the ridge has an outer surface that slopes away from the nozzle.

21. A discharge assembly for mixing at least one stored liquid comprising:

a nozzle having a vertical passage and a horizontal passage integrally formed within a nozzle housing, the horizontal passage having an inlet end for receiving liquid and an outlet end, the vertical passage having a first end fluidly coupled to the outlet end of the horizontal passage and a second end at a liquid dispensing location; and a removable insert having a housing defining an insert passage and having a plurality of inwardly-directed baffles, the insert housing further having a nozzle end near the outlet end of the vertical passage, wherein the insert housing has sidewalls along the insert passage between the first and second ends of the vertical passage, wherein the baffles are perpendicular to the sidewalls and have a uniform thickness, wherein said insert housing has a first inner diameter and a second inner diameter at the nozzle end, the second inside diameter being less than the first inner diameter.

22. A discharge assembly for mixing at least one stored liquid comprising:

a nozzle having a vertical passage and a horizontal passage integrally formed within a nozzle housing, the horizontal passage having an inlet end for receiving liquid and an outlet end, the vertical passage having a first end fluidly coupled to the outlet end of the horizontal passage and a second end at a liquid dispensing location; and a removable insert having a housing defining an insert passage and having a plurality of inwardly-directed baffles, the insert housing further having a nozzle end near the outlet end of the vertical passage, wherein the insert housing has sidewalls along the insert passage between the first and second ends of the vertical passage, wherein the baffles are perpendicular to the sidewalls and have a uniform thickness, wherein the insert includes a plurality of ribs on an outer surface of the insert housing to permit the vertical passage to firmly maintain the insert and to enable slidable removal of the insert from the vertical passage through the outlet end of the vertical passage when a force is applied to the insert.

23. A discharge assembly for mixing at least one stored liquid comprising:

a nozzle having a vertical passage and a horizontal passage integrally formed within a nozzle housing, the horizontal passage having an inlet end for receiving liquid and an outlet end, the vertical passage having a first end fluidly coupled to the outlet end of the horizontal passage and a second end at a liquid dispensing location; and a removable insert having a housing defining an insert passage and having a plurality of inwardly-directed baffles, the insert housing further having a nozzle end near the outlet end of the vertical passage, wherein the insert housing has sidewalls along the insert passage between the first and second ends of the vertical passage, wherein the baffles are perpendicular to the sidewalls and have a uniform thickness, and wherein the second end of the vertical passage has an inner diameter that is sufficient to permit the insertion and removal of the insert through the second end of the vertical passage.

24. A discharge assembly for mixing at least one stored liquid comprising:

a removable insert having a housing defining an insert passage and having a plurality of inwardly-directed baffles, the insert housing having an inlet end and a nozzle end; and a nozzle having sidewalls defining a nozzle passage, and having an inlet end for receiving liquid and an outlet end having an inner diameter that is sufficient to permit the insertion and removal of the insert through the outlet end of the nozzle.

25. The discharge assembly as set fourth in claim 24, wherein the nozzle end of the insert has a ridge that has a maximum outer diameter greater than an outer diameter of the nozzle to provide a gripping surface.

26. The discharge assembly as set forth in claim 25, wherein the ridge has an outer surface that slopes away from the nozzle.

27. The discharge assembly according to claim 26 wherein the insert housing has sidewalls along the insert passage between the inlet and outlet ends of the nozzle passage, wherein the baffles are perpendicular to the sidewalls and have a uniform thickness.

28. The discharge assembly as set forth in claim 25, wherein said insert housing has a first inner diameter and a second inner diameter at the nozzle end, the second inner diameter being less than the first inner diameter.

29. The discharge assembly according to claim 25, wherein the insert includes a plurality of ribs on an outer surface of the insert housing to permit the nozzle passage to firmly maintain the insert and to enable slidable removal of the insert from the nozzle passage through the outlet end of the nozzle passage when a force is applied to the insert.

* * * * *